US006883431B2

(12) United States Patent
Fischer et al.

(10) Patent No.: US 6,883,431 B2
(45) Date of Patent: Apr. 26, 2005

(54) SAFETY DEVICE AND METHOD FOR MONITORING A HAZARDOUS AREA THAT CANNOT BE LOOKED AT IN A PRINTING MACHINE

(75) Inventors: Uwe Fischer, Darmstadt (DE); Hans-Peter Hiltwein, Waghäusel (DE); Carsten Huschle, Bretten (DE); Dirk Naumann, Leimen (DE); Michael Rehberg, Speyer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/112,289

(22) Filed: Mar. 28, 2002

(65) Prior Publication Data

US 2002/0139271 A1 Oct. 3, 2002

(30) Foreign Application Priority Data

Mar. 29, 2001 (DE) ..... 101 15 700

(51) Int. Cl.[7] ..... B41F 33/00

(52) U.S. Cl. ..... 101/484; 101/480; 101/483; 400/54

(58) Field of Search ..... 101/480, 483, 101/484, 342; 400/54; 74/814

(56) References Cited

U.S. PATENT DOCUMENTS

| | | | | | |
|---|---|---|---|---|---|
| 3,641,266 | A | * | 2/1972 | Stults et al. | 348/154 |
| 4,075,961 | A | * | 2/1978 | Harris | 112/277 |
| 4,998,472 | A | * | 3/1991 | Rodi et al. | 101/216 |
| 5,880,954 | A | * | 3/1999 | Thomson et al. | 700/79 |
| 6,240,847 | B1 | * | 6/2001 | Zoll et al. | 101/484 |

* cited by examiner

*Primary Examiner*—Andrew H. Hirshfeld
*Assistant Examiner*—Jill E. Culler
(74) *Attorney, Agent, or Firm*—Laurence A. Greenberg; Werner H. Stemer; Gregory L. Mayback

(57) ABSTRACT

A control system for a printing machine and a safety device for scanning and displaying a hazardous area that cannot be looked at on a printing machine and method thereof includes permitting the printing machine to be started up only after an acknowledgement through a control device that the hazardous area displayed has been examined by an operator.

17 Claims, 2 Drawing Sheets

SAFETY DEVICE AND METHOD FOR MONITORING A HAZARDOUS AREA THAT CANNOT BE LOOKED AT IN A PRINTING MACHINE

BACKGROUND OF THE INVENTION

Field of the Invention

The invention relates to a printing machine having a sensor system that scans a hazardous area and a display at an operating location or station for displaying the hazardous area scanned by the sensor system.

Printing machines nowadays have a large number of safety devices that are used to prevent operating personnel from inadvertently reaching into moving parts. The access to hazardous areas, in particular, nips or gaps between cylinders, is prevented by many types of guarding that, during the normal operation of the printing machine, also remain closed. If it is necessary for the printer, also referred to as the operator herein, to open the access to the hazardous area, for example, to wash or adjust rolls, etc., when the guard is opened, a corresponding contact is actuated and effects a rotational movement of the devices that is only slowed according to an explicit listing by the operator. By appropriate instructions, the printer is then capable of operating the machine such that he is not placed into a hazardous position.

However, within the printing machine, there are also devices that, because of their function, offer no possible guarding or only restricted guarding. These include, for example, the feeder and delivery because manual actions are necessary on these two functional units, such as stack changing, proof sheet removal, adjustment of various alignment and braking elements, and so on. As such, the delivery forms a potential hazard for the operator that can be secured only to a restricted extent. A particular potential hazard is concealed in the delivery because circulating gripper bars located on chains above the delivery paper stack transport the paper sheet out of the printing machine and deposit it over the delivery paper stack. This is less hazardous during normal operation because the delivery paper stack upper edge, viewed physically, is located immediately under the circulating gripper bars, which means that it is not possible for the operator to reach therein. However, a particular potential hazard is concealed in the fact that when the paper stack or paper stack board is lowered, access by the operating personnel is possible, in particular, when, for maintenance work, a plurality of persons perform actions on the printing machine at the same time. For example, the aforementioned washing or adjustment of inking rolls is possible by a momentary-action switch that is to be triggered by the printer, is located between two printing units, for example, and provides the printer with the possibility of moving the machine from such a position. From such a position, firstly the printer is fixed on the task necessary for him to carry out and, secondly, he is restricted in terms of his view by the printing units located in front of or behind him. As a result, he cannot look into the hazardous area in the delivery.

An additional measure to protect the persons located in the hazardous area is to sound a start-up warning, which will be referred to below as ringing, and that must be carried out before the printing machine is started up. To such an end, from the professional association there are corresponding stipulations, in which the time sequence of the pushbuttons to be pressed is described in relation to the ringing. On one hand, the ringing may not be heard by the person located in the hazardous area, and, on the other hand, a number of printing machines located in a print shop can also lead to confusion with regard to the perception of the ringing.

Existing in the prior art are video sensor systems used as protective devices that act without contact to secure hazards on machines and plants and, for example, are marketed by the company Secura-Trans W. Marinitsch GmbH. Such plants are distinguished by the fact that a video sensor system is fitted to a machine or plant over the hazardous area. The current video image recorded by the video sensor system is compared with a stored reference image. An alarm signal is triggered when a difference occurs between the current image and the reference image.

The disadvantage with such a system is that securing a hazardous area in accordance with the facts presented at the beginning, for example, on the delivery of a printing machine, cannot be ensured to the extent required.

SUMMARY OF THE INVENTION

It is accordingly an object of the invention to provide a safety device for monitoring a hazardous area that cannot be looked at in a printing machine that overcomes the hereinafore-mentioned disadvantages of the heretofore-known devices and methods of this general type and that uses a simple control system to enable looking at and securing a hazardous area that cannot be viewed, without restricting the operating function of the printing machines.

With the foregoing and other objects in view, there is provided, in accordance with the invention, a printing machine having at least one operating location and at least one hazardous area, the printing machine having a sensor system scanning the at least one hazardous area, a display electrically connected to the sensor system, the display disposed at the at least one operating location and displaying the at least one hazardous area scanned by the sensor system, and a control device for operating the printing machine, the control device electrically connected to the sensor system and to the display and programmed to permit start-up of the printing machine only after the control device receives an acknowledgement that the at least one hazardous area has been examined.

In accordance with another feature of the invention, a hazardous area that cannot be looked at, such as the delivery of the printing machine, is assigned a sensor system that scans the hazardous area, that is to say, the delivery itself, and a safety margin located around the latter and makes the scanning result accessible to the printer at its respective operating location. The sensor system is advantageously a video camera and the display medium on the operating console of the printer is advantageously a monitor.

In accordance with a further feature of the invention, the printing machine has a safe mode, and the control device is programmed to permit start-up of the printing machine only, first, after the printing machine has been placed in the safe mode, and, second, after the control device receives an acknowledgement that the at least one hazardous area has been examined. Alternatively, the control device is programmed to permit start-up of the printing machine only, first, after receipt of an acknowledgement that the at least one hazardous area has been examined, and, second, after the printing machine has been placed in the safe mode.

If, then, the printer wishes to start up the machine at his operating location, for example, at the printing unit operating location, which is located between two printing units, this can be done only in a safety mode mentioned at the beginning. This is the restricted, slow rotational speed, a travel limited for safety reasons or, in the normal operating case, ringing. Before or thereafter, the display device makes the hazardous area of the delivery accessible to him before the corresponding starting of the printing machine is initiated.

In accordance with an added feature of the invention, the printer is requested to output an appropriate acknowledgement signal before starting up the machine. It is possible for a check to be made that the hazardous area has also actually been looked at before starting up.

In accordance with an additional feature of the invention, the control device is programmed to count through a given time window and to permit start-up of the printing machine only after the control device receives an acknowledgement within the given time window that the at least one hazardous area has been examined.

In accordance with yet a further feature of the invention, the display is also an operating location of the printing machine.

In accordance with yet another feature of the invention, the display medium at the operating location is a touch screen, for example, provided first as a display medium for displaying the hazardous area and second, in a different mode, as an input medium for operation. Advantageously then, as long as the video image is displayed, no operation is possible or the access to the operating level is permitted only when the acknowledgement signal has been provided by the printer. Such a configuration, in turn, has the advantage that only one monitor has to be fitted at one operating location, and fulfills both safety functions and operating functions.

In accordance with yet an added feature of the invention, a plurality of hazardous areas can also be displayed simultaneously or successively on the monitors located at the respective operating location. In the case of simultaneous display, subdividing the monitor into various part images is conceivable. The registration of the different hazardous areas can be carried out by a plurality of sensor systems. In such a variant, the viewing of all the hazardous areas by the operator would have to be acknowledged before the printing machine was started up.

In accordance with again another feature of the invention, following the actuation of a pushbutton to start the machine, a time window is started, during which the monitor is switched on and displays the hazardous area, and an acknowledgement must then be made. If such an acknowledgement is not made, the machine is not started up. If the acknowledgement is present within the time window, the movement of the machine is started up and, in addition, a start-up warning is triggered.

In accordance with yet an additional feature of the invention, the control device is programmed to permit start-up of the printing machine only after the control device receives an acknowledgement by an operator of the printing machine that the at least one hazardous area has been examined.

In accordance with again a further feature of the invention, the display advantageously has an emergency off pushbutton or switch, which provides the operator with the possibility of stopping the machine. Preferably, the emergency off switch is on the display. Such a configuration could be advantageous when an operator is standing at his operating location, for example, the control desk of the machine, and, as a result, can observe a colleague who is working on the delivery system, in order to bring about an emergency stop of the machine in the event that the colleague is in danger.

With the objects of the invention in view, in a printing machine having a hazardous area and an operating location, there is also provided a safety system including a sensor system scanning the hazardous area, a display electrically connected to the sensor system, the display disposed at the operating location of the printing machine and displaying the hazardous area scanned by the sensor system, and a control device electrically connected to the sensor system and to the display and programmed to permit start-up of the printing machine only after the control device receives an acknowledgement that the hazardous area has been examined.

With the objects of the invention in view, there is also provided a method for securing at least one hazardous area of a printing machine, including the steps of scanning a hazardous area of the printing machine with a sensor system, placing a display at an operating location of the printing machine, displaying at least the hazardous area scanned by the sensor system on the display, and controlling operation of the printing machine by permitting start-up of the printing machine only after an acknowledgement is received indicating that the hazardous area has been examined.

With the invention, the operation of the printing machine becomes safer, without restrictions having to be tolerated in the actual operating case.

Other features that are considered as characteristic for the invention are set forth in the appended claims.

Although the invention is illustrated and described herein as embodied in a safety device for monitoring a hazardous area that cannot be looked at in a printing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
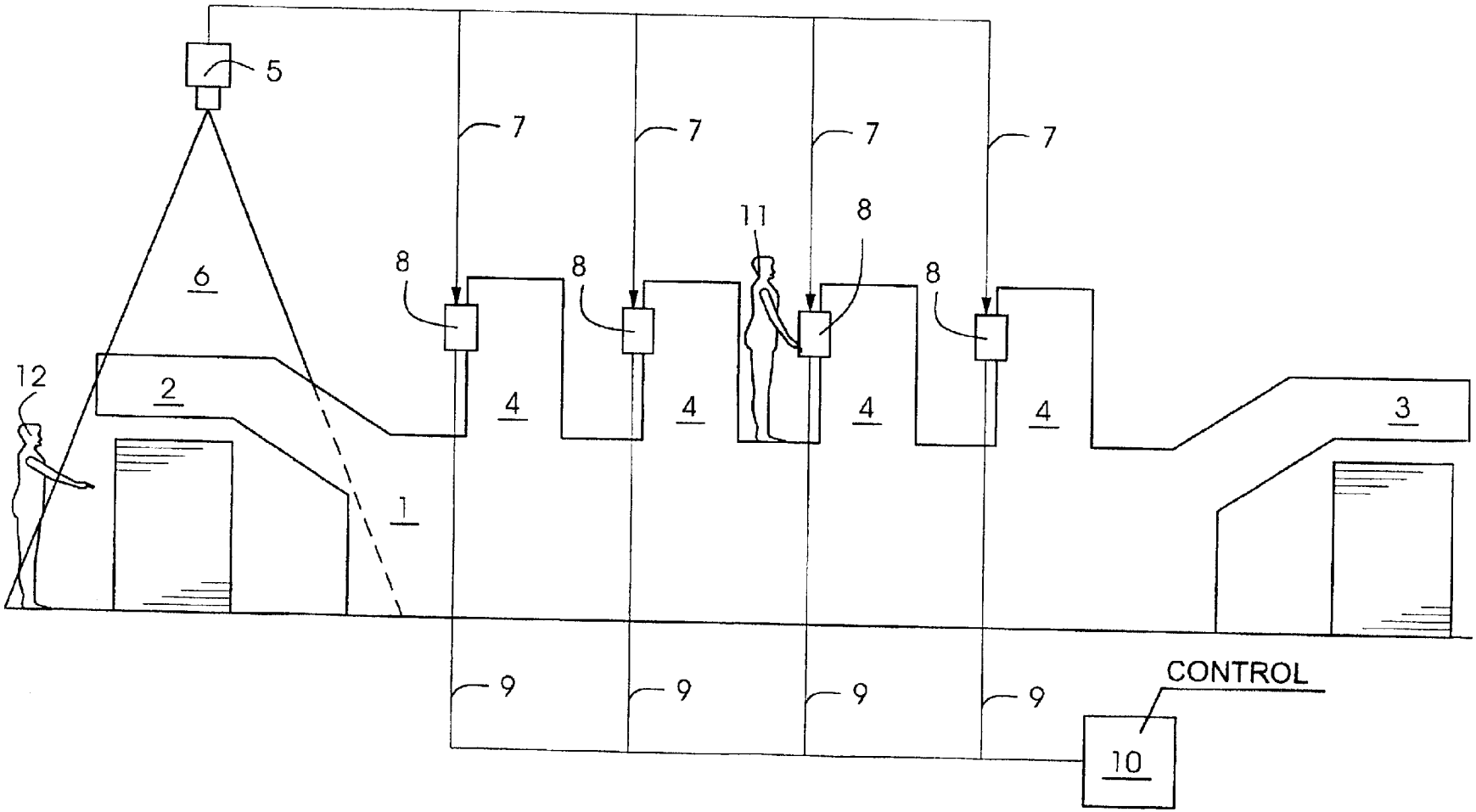
FIG. 1 is a diagrammatic side elevational view of a printing machine with a sensor unit aimed at the delivery according to the invention.

Referring now to the figures of the drawings in detail and first, particularly to FIG. 1 thereof, there is shown a printing machine 1 having a delivery 2, a feeder 3, and a plurality of printing units 4. Above the delivery 2 there is a sensor device 5 that scans a hazardous area 6 without contact. The sensor system 5 is connected by data lines 7 to various display media 8 located on the printing units 4. On the display media 8 there are also non-illustrated operating elements such as a start-up pushbutton or switch, an acknowledgement pushbutton, and other pushbuttons or switches required to operate the machine. From the display media 8, signals run through data lines 9 to a control device 10, which makes it possible to start up the machine and to drive the non-illustrated motors. As already mentioned in the introduction, the sensor system 5 sends to the display media 8 a signal that, for example, corresponds to the depiction of the hazardous area 6. If, then, there is an operator 11 between two printing units 4, in order to carry out appropriate maintenance work such as washing the inking rolls, then it is possible for the operator 11 to detect a further person 12 located in the hazardous area and to delay the starting of the machine until the operator 12 has moved out of the hazardous area 6. The start-up sequence will be explained in more detail below using the flowchart of FIG. 2.

Figure 2:
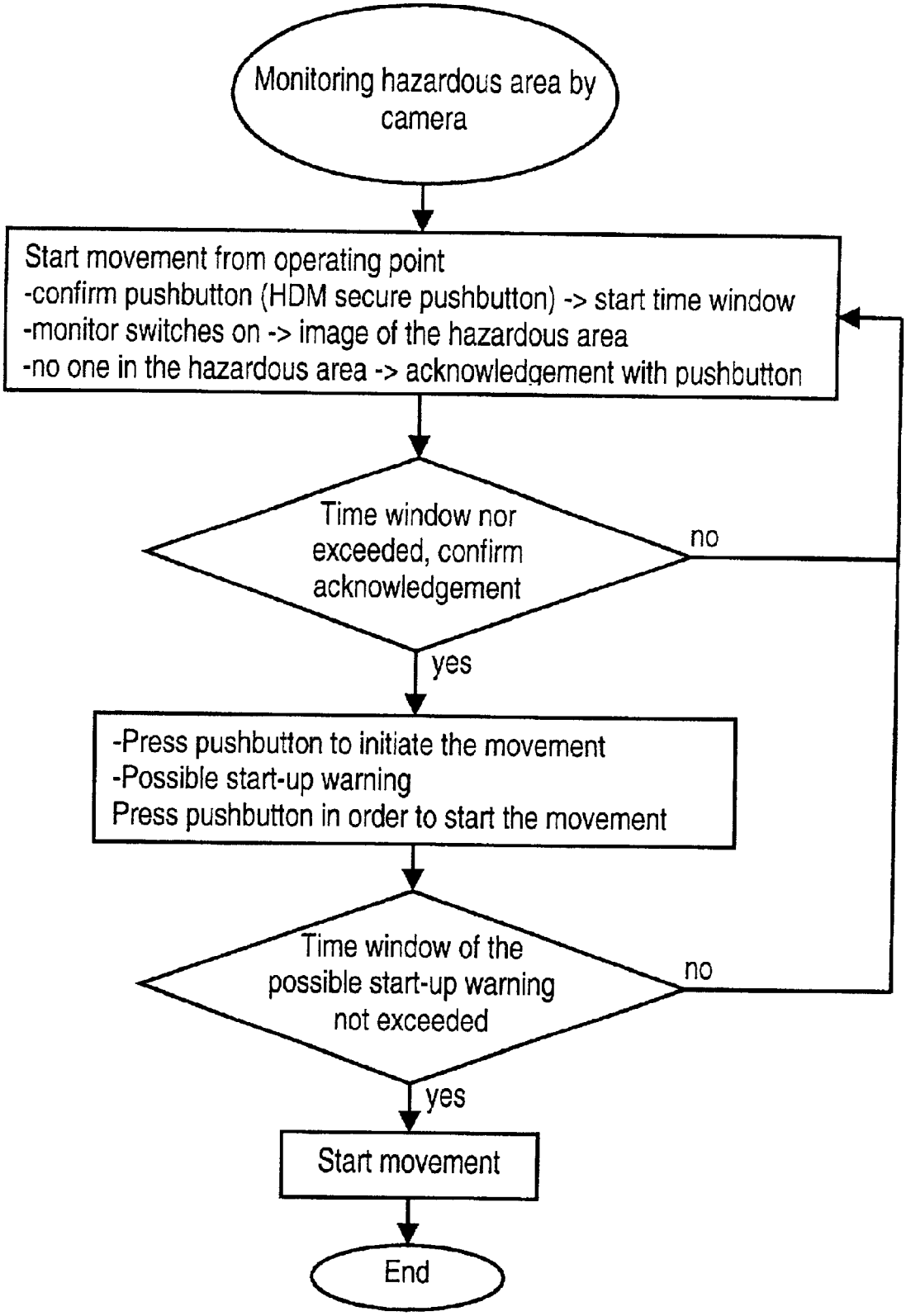
FIG. 2 is a flowchart detailing a start up of the printing machine according to the invention.

FIG. 2 represents the sequence of starting up the printing machine, with the monitoring of the hazardous area by a sensor system 5 being assumed. From the operating location on a printing unit 4 belonging to the printing machine 1, the secure pushbutton, as it is referred to herein, is pressed and permits the printer to have restricted operation of the printing machine (slow movement=safety mode). After the secure pushbutton has been actuated, a time window is started and the display medium 8 switches on and depicts the hazardous area at the operating location. If the pushbutton "no one in the hazardous area" is acknowledged by the operator 11, a check is made in a further interrogation step to see whether the acknowledgement was made within the time window or not. If the answer is affirmative, a further pushbutton can be pressed to initiate the movement. In such a case, the machine may possibly trigger a start-up warning. In accordance with a further safety stipulation, the pushbutton to initiate the movement must be pressed again. In a further query, a check is made to see whether the second pressing of the pushbutton has taken place within the start-up warning, as a result of which the movement of the machine is then started, or not.

We claim:

1. A printing machine having at least one operating location and at least one hazardous area, the printing machine comprising:

a sensor system scanning the at least one hazardous area;

a display electrically connected to said sensor system, said display:

disposed at the at least one operating location; and displaying the at least one hazardous area scanned by said sensor system; and a control device for operating the printing machine, said control device:

electrically connected to said sensor system and to said display; and programmed to count through a given time window and to permit start-up of the printing machine only after said control device receives an acknowledgement within said given time window that the at least one hazardous area has been examined.

2. The apparatus according to claim 1, wherein:

the printing machine has a safe mode; and said control device is programmed to permit start-up of the printing machine only:

first, after the printing machine has been placed in the safe mode; and second, after said control device receives an acknowledgement that the at least one hazardous area has been examined.

3. The apparatus according to claim 1, wherein:

the printing machine has a safe mode; and said control device is programmed to permit start-up of the printing machine only:

first, after receipt of an acknowledgement that the at least one hazardous area has been examined; and second, after the printing machine has been placed in the safe mode.

4. The apparatus according to claim 1, wherein said display is also an operating location of the printing machine.

5. The apparatus according to claim 1, wherein:

the printing machine has hazardous areas; and some of hazardous areas are displayed on said display.

6. The apparatus according to claim 5, wherein a plurality of hazardous areas are displayed simultaneously on said display.

7. The apparatus according to claim 1, wherein said display has an emergency off switch electrically connected to said control device for shutting off the printing machine.

8. The apparatus according to claim 7, wherein said emergency off switch is a push-button.

9. The apparatus according to claim 1, wherein said control device is programmed to permit start-up of the printing machine only after said control device receives an acknowledgement by an operator of the printing machine that the at least one hazardous area has been examined.

10. In a printing machine having a hazardous area and an operating location, a safety system comprising:

a sensor system scanning the hazardous area;

a display electrically connected to said sensor system, said display:

disposed at the operating location of the printing machine; and displaying the hazardous area scanned by said sensor system; and a control device:

electrically connected to said sensor system and to said display; and programmed to count through a given time window and to permit start-up of the printing machine only after said control device receives an acknowledgement within said given time window that the at least one hazardous area has been examined.

11. A method for securing at least one hazardous area of a printing machine, which comprises:

scanning a hazardous area of the printing machine with a sensor system;

placing a display at an operating location of the printing machine;

defining a time window;

displaying at least the hazardous area scanned by the sensor system on the display; and controlling operation of the printing machine by permitting start-up of the printing machine only after an acknowledgement is received within the time window indicating that the hazardous area has been examined.

12. The method according to claim 11, which further comprises permitting start-up of the printing machine only after receipt by the printing machine of an acknowledgement by an operator of the printing machine indicating that the hazardous area has been examined by the operator.

13. The method according to claim 11, which further comprises permitting start-up of the printing machine only after:

first placing the printing machine in a safe mode; and thereafter receiving an acknowledgement indicating that the hazardous area has been examined.

14. The method according to claim 11, which further comprises permitting start-up of the printing machine only after:

first receiving an acknowledgement indicating that the hazardous area has been examined; and thereafter placing the printing machine in a safe mode.

15. The method according to claim 11, wherein the display is the operating location of the printing machine.

16. The method according to claim 11, which further comprises simultaneously displaying more than one of the hazardous areas of the printing machine on the display.

17. The method according to claim 11, which further comprises providing an emergency off switch on the display to shut off the printing machine.

* * * * *